United States Patent [19]

Schindler

[11] Patent Number: 4,522,700

[45] Date of Patent: Jun. 11, 1985

[54] COAL LIQUEFACTION

[75] Inventor: Harvey D. Schindler, Fairlawn, N.J.

[73] Assignee: The Lummus Company, Bloomfield, N.J.

[21] Appl. No.: 640,235

[22] Filed: Aug. 13, 1984

Related U.S. Application Data

[63] Continuation of Ser. No. 531,952, Sep. 14, 1983, abandoned, which is a continuation of Ser. No. 290,246, Aug. 5, 1981, abandoned.

[51] Int. Cl.[3] ..... C10G 1/06

[52] U.S. Cl. ..... 208/8 LE

[58] Field of Search ..... 208/8 LE, 11 LE

[56] References Cited

U.S. PATENT DOCUMENTS

| | | | |
|---|---|---|---|
| 3,477,941 | 11/1969 | Nelson | 208/11 LE |
| 4,189,371 | 2/1980 | Maa et al. | 208/11 LE |
| 4,190,518 | 2/1980 | Giannetti et al. | 208/11 LE |
| 4,328,088 | 5/1982 | Anderson et al. | 208/11 LE |
| 4,372,838 | 2/1983 | Kulik et al. | 208/11 LE |

FOREIGN PATENT DOCUMENTS

| | | | |
|---|---|---|---|
| 0001064 | 12/1979 | Int'l Pat. Institute | 208/11 LE |
| 8102306 | 8/1981 | Int'l Pat. Institute | 208/11 LE |

*Primary Examiner*—D. E. Gantz
*Assistant Examiner*—A. Pal
*Attorney, Agent, or Firm*—Elliot M. Olstein

[57] ABSTRACT

In a two-stage liquefaction wherein coal, hydrogen and liquefaction solvent are contacted in a first thermal liquefaction zone, followed by recovery of an essentially ash free liquid and a pumpable stream of insoluble material, which includes 850° F.+ liquid, with the essentially ash free liquid then being further upgraded in a second liquefaction zone, the liquefaction solvent for the first stage includes the pumpable stream of insoluble material from the first liquefaction stage, and 850° F.+ liquid from the second liquefaction stage.

13 Claims, 1 Drawing Figure

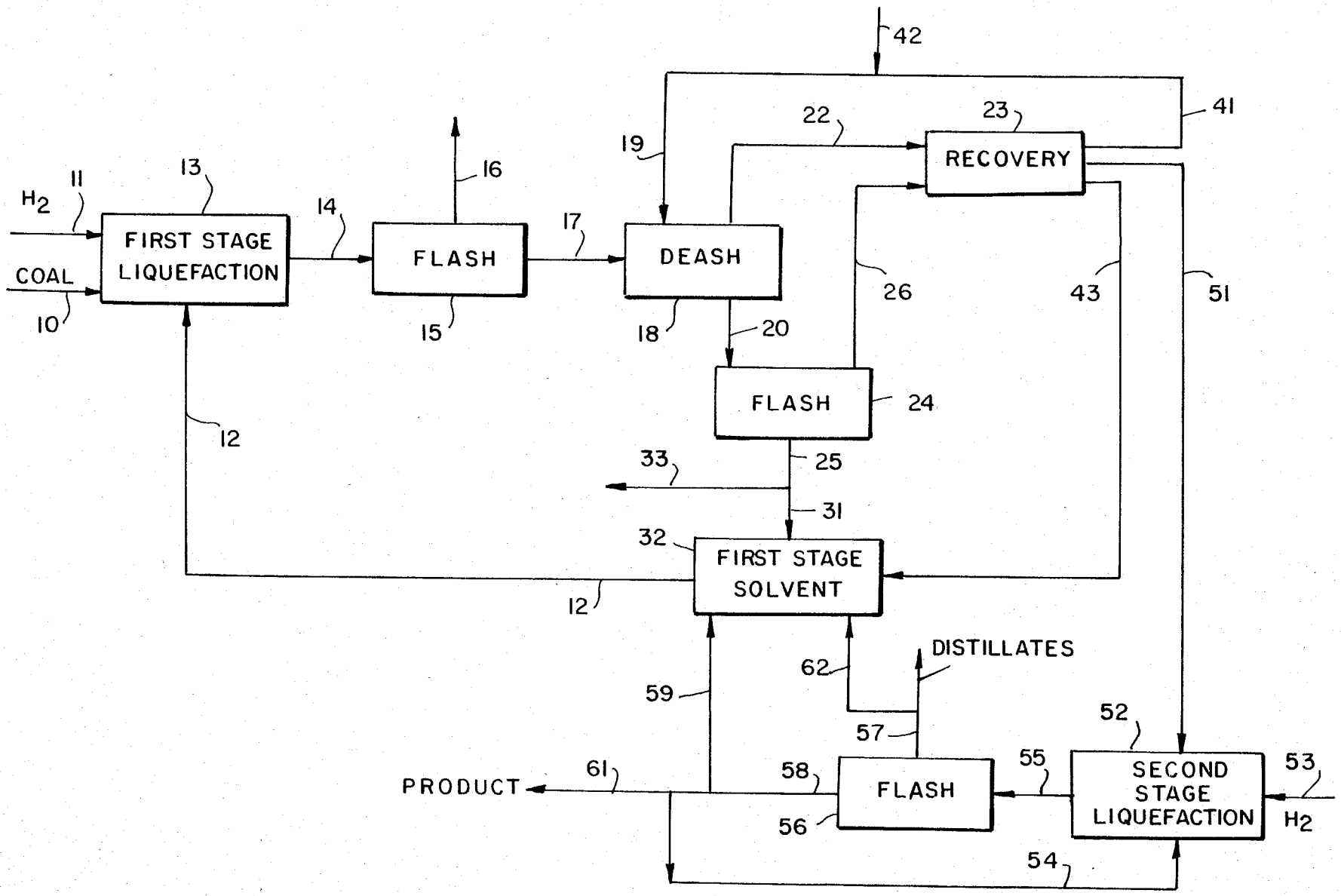
H2
COAL
FIRST STAGE LIQUEFACTION
FLASH
DEASH
RECOVERY
FLASH
FIRST STAGE SOLVENT
FLASH
SECOND STAGE LIQUEFACTION
H2
DISTILLATES
PRODUCT
10
11
12
13
14
15
16
17
18
19
20
22
23
24
25
26
31
32
33
41
42
43
51
52
53
54
55
56
57
58
59
61
62

COAL LIQUEFACTION

The Government of the United States of America has rights in this invention pursuant to Contract No. DEAC02-79ET-14804, awarded by the United States Energy Research and Development Administration.

This application is a continuation of Ser. No. 531,952, filed 09/14/1983, which is a continuation of Ser. No. 290,246, filed 08/05/1981, now both abandoned.

The present invention relates to liquefaction of coal, and more particularly to improvements in a two-stage process for coal liquefaction.

Coal has been liquefied in a single liquefaction stage comprised of a preheater coil where coal liquefaction is essentially completed, followed by a dissolver, where both liquefaction solvent and coal derived liquids are further hydrogenated.

Recently, there has been proposed a so-called two-stage liquefaction process wherein the first reaction stage is a short contact time thermal liquefaction, followed by recovery of essentially ash free liquid, which is further upgraded in a second liquefaction stage.

The present invention is directed to an improvement in such a two-stage liquefaction process.

In accordance with the present invention, there is provided an improvement in a two-stage liquefaction process wherein the liquefaction solvent to the first stage includes a pumpable stream of insoluble material (ash, undissolved coal, etc.), which includes 850° F.+ liquid, recovered from the first stage liquefaction, and 850° F.+ liquid recovered from the second stage liquefaction. Thus, the liquefaction solvent to the first stage includes heavy material (which includes insolubles) from the first stage, and heavy material from the second stage.

More particularly, the first stage liquefaction is a short contact thermal liquefaction which is operated at an outlet temperature in the order of from 830° F. to 875° F., at a pressure in the order of from 1800 to 2700 psig, and at reaction contact times (at temperatures above 600° F.) in the order of from 3 to 15 minutes. The coal liquefaction solvent employed in the first stage is provided in an amount such that the ratio of solvent to coal is in the order of from 1.2:1 to 3:1, on a weight basis. It is to be understood that greater amounts could be employed but, in general, such greater amounts are not economically justified. In addition, hydrogen is generally added to the first stage in an amount of from 4000 to 15,000 SCF per ton of coal.

After treatment to remove insoluble matter, 850° F.+ liquid which is essentially free of insoluble material is liquefied in a second stage to further upgrade the material.

In accordance with the present invention, the pumpable stream of insoluble material (ash, undissolved coal, etc.), which includes 850° F.+ liquid (generally at least 45%, and most generally about 45% to 55% of the stream is 850° F.+ liquid, with the remainder being insoluble material), which is recovered from the deashing, is employed in formulating the liquefaction solvent from the first stage.

In accordance with the invention, the coal liquefaction solvent which is used in the first stage of the process is comprised of from 15% to 50%, and most generally from 20% to 40%, of 850° F.+ liquid, from 5% to 20%, most generally from 5% to 10%, of insoluble material, with the remainder being 850° F.− liquid having an initial boiling point of at least 500° F., with the 850° F.− liquid being present in the solvent in an amount of at least 45%, and most generally in an amount of at least 50% all by weight. In addition, at least 10% and up to 40% of the liquefaction solvent is derived from the pumpable stream of insoluble material recovered from the first stage deashing and at least 25% of the liquefaction solvent is derived from the second stage. The portion derived from the second stage can be the 850° F.+ alone or both 850° F.+ and 850° F.− liquid, with, in most cases, the liquid derived from the second stage being primarily the 850° F.+ liquid. Thus, the liquefaction solvent is comprised of liquid which boils above 500° F., with the liquefaction solvent including 850° F.+ material (the full range of material, excluding insolubles, derived from the coal) recovered from both the first and second stages.

In accordance with a preferred embodiment, the first stage effluent is deashed by the use of a liquid promoter having a characterization factor of at least 9.75, a 5 volume percent distillation temperature of at least about 250° F., and a 95 volume percent distillation temperature of at least about 350° F. and no greater than about 750° F., as described in U.S. Pat. No. 3,856,675. As described in such patent, a preferred promoter liquid is a kerosene fraction having a 5% and 95% volume distillation temperature of 425° F. and 500° F., respectively.

Liquid essentially free of insoluble material (no more than 0.5% ash) recovered from the deashing is then treated in a recovery zone to recover promoter liquid, if such promoter liquid is employed in the deashing, components boiling below 850° F., which are used in formulating the liquefaction solvent, with higher boiling materials, i.e., 850° F.+ material, being employed as feed to the second stage liquefaction. A pumpable stream of insoluble material, which includes 850° F.+ liquid is also recovered from the deashing and a portion thereof is used in formulating the solvent.

In the second stage liquefaction, the 850° F.+ material, is contacted with hydrogen, and second stage liquefaction solvent at temperatures in the order of from 750° F. to 850° F., and at pressures in the order of from 2000 to 3000 psig, with contact times being in the order of from 1 to 5 hours. In the second stage, such contacting is effected in the presence of a coal liquefaction catalyst of a type known in the art. For example an oxide or sulfide of a group VI and group VIII metal, such as cobalt-molybdenum or nickel-molybdenum catalyst, supported on a suitable support such as alumina or silica-alumina.

In accordance with a preferred embodiment, such second-stage liquefaction is accomplished in an upflow ebullated bed, with such ebullated beds being known in the art.

The effluent from the second stage liquefaction is then subjected to a flashing step to recover lighter components therefrom; i.e., components boiling below about 850° F., with the remaining product being used to provide liquefaction solvent to the second stage, a portion of the liquefaction solvent requirements for the first stage, and net liquefaction product.

The invention will be further described with respect to an embodiment thereof illustrated in the accompanying drawing, wherein:

The drawing is a simplified schematic block flow diagram of an embodiment of the invention.

It is to be understood, however, that the scope of the invention is not to be limited to the particularly described embodiment.

BRIEF DESCRIPTION OF DRAWING

Referring now to the drawing, ground pulverized coal, generally bituminous, sub-bituminous or lignite, preferably bituminous coal, in line 10, hydrogen in line 11, and a coal liquefaction solvent, in line 12, obtained as hereinafter described, are introduced into the first stage liquefaction zone, schematically generally indicated as 13 for effecting a short contact thermal liquefaction of the coal. The thermal liquefaction is effected in the absence of catalyst. The first stage liquefaction is operated at the conditions hereinabove described.

A first stage coal liquefaction product is withdrawn from zone 13 through line 14, and introduced into a flash zone, schematically generally indicated as 15 in order to flash therefrom materials boiling up to about 500° to 600° F. Such flashed materials are removed from flash zone 15 through line 16. The flash zone 15 is operated primarily for the purpose of flashing materials which boil up to the end point of the promoter liquid to be employed in the subsequent deashing process.

The remainder of the coal liquefaction product, in line 17, is introduced into a deashing zone, schematically generally indicated as 18 for separating ash and other insoluble material from the first stage coal liquefaction product. A particularly described, the deashing in zone 18 is accomplished by use of a promoter liquid for promoting and enhancing the separation of the insoluble material, with such promoter liquid being provided through line 19. In particular, the separation in deashing zone 18 is accomplished in one or more gravity settlers, with the promoter liquid and general procedure for accomplishing such deashing being described, for example, in U.S. Pat. No. 3,856,675.

The essentially ash free overflow is withdrawn from deashing zone 18 through line 22 for introduction into a recovery zone, schematically generally indicated as 23.

An insoluble material containing underflow is withdrawn from deashing zone 18 through line 20, and introduced into a flash zone, schematically generally indicated as 24 to flash materials boiling below 850° F. therefrom. The flashing in zone 24 is accomplished in a manner such that there is recovered from flash zone 24, through line 25, a flowable insoluble material containing 850° F.+ liquid. The flashed components are withdrawn from flash zone 24 through line 26 for introduction into the recovery zone 23.

A portion of the 850° F.+ material in line 31 is introduced into a first stage solvent zone, schematically generally indicated as 32 for formulating the first stage liquefaction solvent, as hereinafter described.

The remaining portion of the material in line 33 may be used as feedstock to a partial oxidation process for producing hydrogen.

The recovery zone 23 may include one, two or more distillation columns which are designed and operated to recover the promoter liquid through line 41 for subsequent introduction into deashing zone 18 through line 19, after addition of make up promoter liquid, as required, through line 42.

In addition, there is recovered through line 43 a stream which boils within the range from about 600° to about 900° F. for use in formulating the first stage liquefaction solvent in first stage liquefaction solvent zone 32.

850° F.+ material is recovered from the recovery zone 23 through line 51 for introduction into a second stage liquefaction zone, schematically generally indicated as 52, along with hydrogen in line 53 and second stage liquefaction solvent in line 54. The second stage liquefaction zone 52 is operated at temperatures, and pressures, as hereinabove described, preferably with the use of a coal liquefaction catalyst of the type hereinabove described.

In accordance with a preferred embodiment, the second liquefaction stage is in the form of an upflow ebullated bed.

The effluent from the second stage liquefaction, in line 55 is introduced into a flash zone, schematically generally indicated as 56 to flash therefrom materials boiling below about 850° F., with such lower boiling materials being recovered through line 57. Optionally some of the material in line 57 may be employed in line 62 for formulating liquefaction solvent.

The 850° F.+ product recovered from flash zone 56 through line 58 is employed for providing second stage liquefaction solvent through line 56, and for formulating first stage liquefaction solvent through line 59.

The remaining portion is recovered through line 61 as net product.

The first stage liquefaction solvent in line 32 is thus formulated by combining material boiling within the range from 600° F. to 900° F., in line 43, 850° F.+ liquid, which includes insolubles in line 31, and 850° F.+ material from the second stage liquefaction in line 59. Optionally, some of the lighter material recovered from the second stage may be used in formulating the first stage solvent.

Although the invention has been described with respect to a particular embodiment, it is to be understood that the invention is not limited to such embodiment. Thus, for example, the deashing may be accomplished other than as particularly described. Similarly, the second stage liquefaction may be accomplished other than as particularly described; i.e., other than by use of an upflow ebullated bed.

These modifications and others should be apparent to those skilled in the art from the teachings herein.

The present invention is advantageous in that 850° F.+ material derived from the coal is used for providing a portion of the liquefaction solvent and a portion of such 850° F.+ material is provided from the pumpable stream of insolubles recovered from the deashing thereby reducing the amount of material required from the second stage for formulating first stage liquefaction solvent.

Numerous modifications and variations of the present invention are possible in light of the above teachings and, therefore, within the scope of the appended claims, the invention may be practised otherwise than as particularly described.

I claim:

1. In a process for the two-stage liquefaction of coal wherein coal is liquefied in a first stage thermal liquefaction zone with a first stage liquefaction solvent to produce a first effluent; first effluent is deashed to recover an essentially ash free liquid and a pumpable stream consisting essentially of insoluble material and 850° F.+ liquid; essentially ash free 850° F.+ liquid is recovered from the first effluent and contacted with hydrogen in a second stage to upgrade the essentially ash free liquid and produce a second effluent, 850° F.+ liquid is recovered from the second effluent; and 850° F.− liquid having an initial boiling point of at least 500° F. is recovered from the first and second effluent, the improvement comprising:

said first stage liquefaction solvent consisting essentially of a portion of the pumpable stream recovered from the first effluent, a portion of 850° F.+ liquid which is recovered from the second stage effluent and directly utilized in the liquefaction solvent (without additional hydrogenation) and 850° F.− liquid having an initial boiling point of at least 500° F. recovered from both the first and second effluents and directly utilized in the liquefaction solvent (without additional hydrogenation), said first stage liquefaction solvent consisting essentially of 15% to 50% of 850° F.+ liquid, 5% to 20% of insoluble material and at least 45% of 850° F.− liquid having an initial boiling point of at least 500° F., with at least 10% of said first stage liquefaction solvent being obtained from said pumpable stream and at least 25% of the first stage liquefaction solvent being 850° F.+ liquid obtained from the second stage liquid effluent, said first stage liquefaction solvent providing the solvent requirements for the first stage liquefaction.

2. The process of claim 1 wherein the pumpable stream is comprised of from 45% to 50% of 850° F.+ liquid and the remainder is insoluble material.

3. The process of claim 1 wherein the liquefaction solvent for the first stage contains from 20% to 40% of 850° F.+ liquid.

4. The process of claim 3 wherein the liquefaction solvent for the first stage contains from 5% to 10% of the insoluble material.

5. The process of claim 3 wherein no greater than 40% of the first stage liquefaction solvent is derived from said pumpable stream.

6. The process of claim 1 wherein the first stage thermal liquefaction is operated at an outlet temperature of from 830° F. to 875° F., a pressure from 1800 to 2700 psig, a residence time of from 3 to 15 minutes and in the absence of catalyst.

7. The process of claim 6 wherein the second stage liquefaction is effected in an upflow ebullated bed.

8. The process of claim 6 wherein first effluent is deashed by use of a deashing liquid.

9. In a process for the two-stage liquefaction of coal wherein coal is liquefied in a first stage thermal liquefaction zone with a first stage liquefaction solvent to produce a first effluent; first effluent is deashed to recover an essentially ash free liquid and a pumpable stream consisting essentially of insoluble material and 850° F.+ liquid; essentially ash free 850° F.+ liquid is recovered from the first effluent and contacted with hydrogen in a second stage to upgrade the essentially ash free liquid and produce a second effluent; and 850° F.+ liquid is recovered from the second effluent, the improvement comprising:

employing said pumpable stream recovered from the deashing and the 805° F.+ liquid recovered from the second effluent in said first stage liquefaction solvent, said pumpable stream being employed in an amount to provide from 5% to 20% of insoluble material in the first stage liquefaction solvent, and said 850° F.+ liquid recovered from the second effluent being employed in an amount to provide at least 25% of the first stage liquefaction solvent, said 850° F.+ liquid being substantially the full range of material derived from the coal.

10. The process of claim 9 wherein the pumpable stream is comprised of from 45% to 50% of 850° F.+ liquid and the remainder is insoluble material.

11. The process of claim 10 wherein no greater than 40% of the first stage liquefaction solvent is derived from said pumpable stream.

12. The process of claim 9 wherein the first stage thermal liquefaction is operated at an outlet temperature of from 830° F. to 875° F., a pressure from 1800 to 2700 psig, a residence time of from 3 to 15 minutes, and in the absence of catalyst.

13. The process of claim 12 wherein first effluent is deashed by use of a deashing liquid.

* * * * *